US006484686B1

(12) United States Patent
Ordanic

(10) Patent No.: US 6,484,686 B1
(45) Date of Patent: Nov. 26, 2002

(54) METHOD AND SYSTEM FOR IDLING A DIESEL ENGINE

(75) Inventor: Zlatko Ordanic, Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/625,757

(22) Filed: Jul. 26, 2000

(51) Int. Cl.[7] ..... F02B 77/00
(52) U.S. Cl. ..... 123/198 F; 123/481
(58) Field of Search ..... 123/198 F, 481, 123/480, 5.21, 434

(56) References Cited

U.S. PATENT DOCUMENTS

| | | | | |
|---|---|---|---|---|
| 4,494,502 A | * | 1/1985 | Endo et al. | 123/198 F |
| 4,781,160 A | * | 11/1988 | Luhr et al. | 123/198 F |
| 4,825,829 A | | 5/1989 | Abe | 123/339 |
| 4,829,960 A | | 5/1989 | Yuzawa et al. | 123/339 |
| 4,966,111 A | | 10/1990 | Fujimoto et al. | 123/399 |
| 5,054,450 A | | 10/1991 | Oota et al. | 123/478 |
| 5,199,326 A | | 4/1993 | Iwatsuki et al. | 74/873 |
| 5,513,609 A | | 5/1996 | Hirose et al. | 123/339.14 |
| 5,584,266 A | * | 12/1996 | Motose et al. | 123/198 F |
| 5,775,291 A | | 7/1998 | Choi | 123/339.15 |
| 5,826,563 A | * | 10/1998 | Patel et al. | 123/481 |
| 5,954,025 A | | 9/1999 | Kanamaru et al. | 123/339.11 |
| 6,186,114 B1 | * | 2/2001 | Nakamura | 123/335 |

* cited by examiner

*Primary Examiner*—Bibhu Mohanty
(74) *Attorney, Agent, or Firm*—Woodard, Emhardt, Naughton, Moriarty & McNett

(57) ABSTRACT

A system is disclosed for implementing a technique for idling a diesel engine. The system comprises an engine controller, an air temperature sensor, and an engine speed sensor. The air temperature sensor provides a first signal indicative of an internal temperature of an intake manifold in fluid communication with the diesel engine. The engine speed sensor provides a second signal indicative of a rotational speed of a crankshaft of the diesel engine. In response to various other signals collectively indicating the diesel engine is idling, the engine controller controls the supply of fuel to the diesel engine as a function of the first signal. When the first signal is below a temperature level, engine controller supplies fuel to each combustion chamber of the diesel engine for a fixed period of time to achieve a desired range of rotational speeds of the crankshaft as indicated by the second signal. Thereafter, the engine controller supplies fuel to a subset of the combustion chambers to achieve a higher range of rotational speeds of the crankshaft as indicated by the second signal. When the first signal is at or above the temperature level, engine controller supplies fuel to each combustion chamber of the diesel engine to achieve a desired range of rotational speeds of the crankshaft as indicated by the second signal.

13 Claims, 3 Drawing Sheets

METHOD AND SYSTEM FOR IDLING A DIESEL ENGINE

TECHNICAL FIELD OF THE INVENTION

The present invention generally relates to control methods and systems for diesel engines, and more specifically, but not exclusively, relates to a technique for injecting fuel into a first set of one or more combustion chambers and/or a second set of one or more combustion chambers of the diesel engine when idling the diesel engine based upon temperature ambient the diesel engine.

BACKGROUND OF THE INVENTION

A diesel engine in an idling state can experience incomplete combustion of fuel within the combustion chambers of the diesel engine if the temperature ambient the diesel engine is too low. As a result, structural damage to the diesel engine can occur. For example, while a diesel engine is idling at an ambient temperature of 10° F. or less, distillates of unburned fuel within a combustion chamber may precipitate on a corresponding valve of the diesel engine. Consequently, the valve can get stuck within a respective valve seat whereby a corresponding push tube of the diesel engine can be bent. Therefore, there is a need for an engine control method and system for diminishing, if not eliminating, any potential creation of distillates within the combustion chambers of a diesel engine while the diesel engine is idling.

SUMMARY OF THE INVENTION

The objective of the present invention is to address the need for significantly decreasing, if not eliminating, any potential creation of distillates within a combustion chamber while a diesel engine is idling. Various aspects of the present invention are novel, nonobvious, and provide various advantages. While the actual nature of the invention covered herein can only be determined with reference to the claims appended hereto, certain features which are characteristic of the various forms disclosed herein are described briefly as follows.

One form of the present invention is a unique method for injecting fuel into only a first set of combustion chambers of a diesel engine while the diesel engine is idling in a first state, and injecting fuel into both the first set of combustion chambers and a second set of combustion chambers of the diesel engine while the diesel engine is idling in a second state. The first state and the second state are based upon the temperature ambient to the diesel engine.

Another form of the present invention is a unique vehicle comprising a diesel engine and a controller. The controller is operable to control an injection of fuel into only a first set of combustion chambers of the diesel engine while the diesel engine is idling in a first state. The controller is further operable to control an injection of fuel into both the first set of combustion chambers and a second set of combustion chambers of the diesel engine while the diesel engine is idling in a second state. The first state and the second state are based upon the temperature ambient to the diesel engine.

Further forms, objects, features, aspects, benefits, and advantages of the present invention will become apparent from the drawings and description contained herein.

DESCRIPTION OF THE PREFERRED EMBODIMENT

Figure 1:
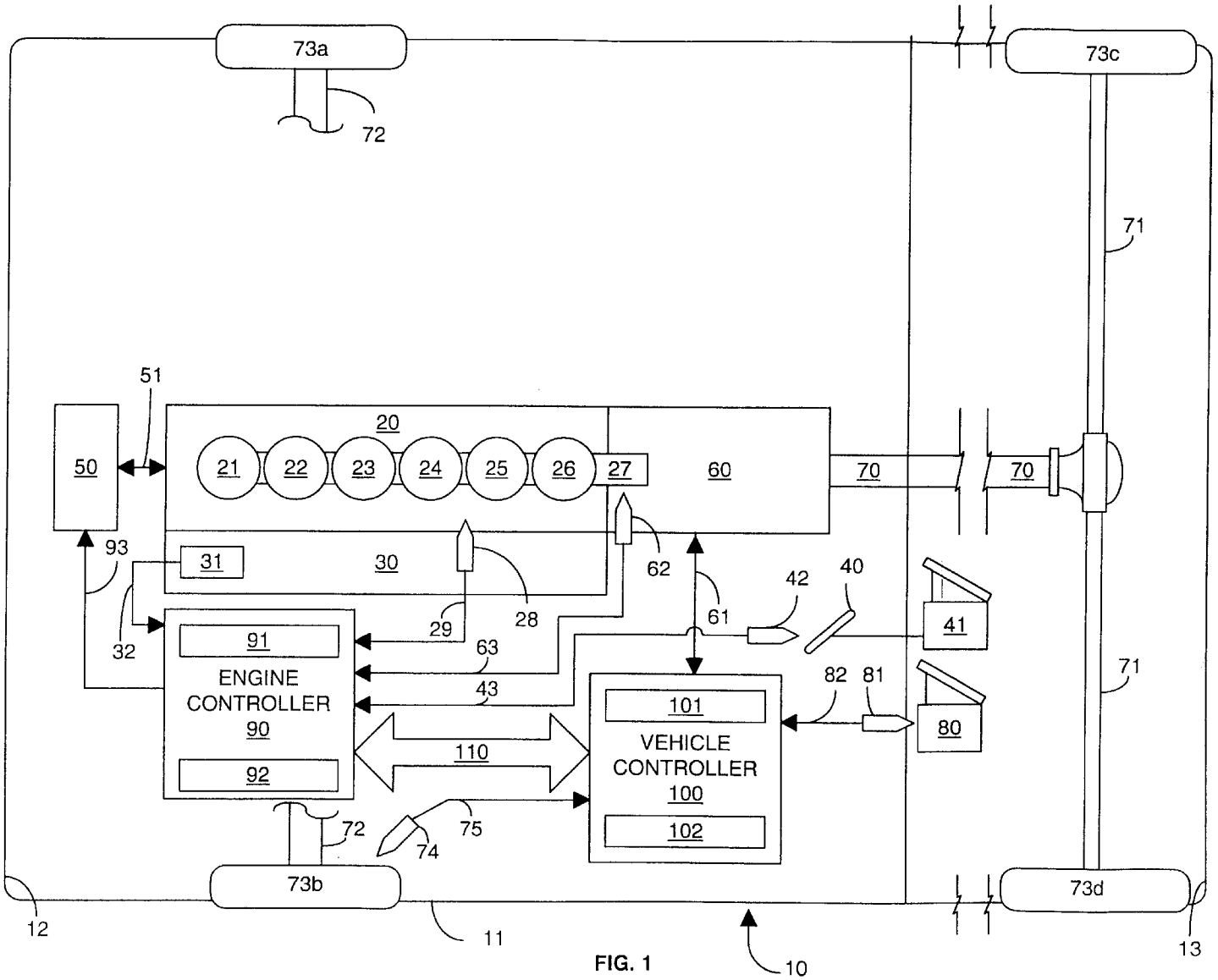
FIG. 1 is a schematic view of one embodiment a vehicle of the present invention.

For the purposes of promoting an understanding of the principles of the present invention, reference will now be made to the embodiments illustrated in the drawings and specific language will be used to describe the same. It will nevertheless be understood that no limitation of the scope of the present invention is thereby intended. Any alterations and further modifications in the illustrated embodiments, and any further applications of the principles of the present invention as illustrated herein being contemplated as would normally occur to one skilled in the art to which the present invention relates.

FIG. 1 depicts a vehicle 10 comprising a vehicle chassis/body 11 defining an engine compartment 12 and an operator compartment 13. While vehicle 10 can be any type of vehicle, preferably vehicle 10 is a light-duty truck. Within compartment 12, vehicle 10 comprises a diesel engine 20 (hereinafter "engine 20"), an intake manifold 30, a throttle 40, a fueling system 50, and a transmission 60.

Engine 20 is of the four stroke diesel-fueled type with Compression Ignition (CI) having intake manifold 30 is in fluid communication therewith. In other embodiments, engine 20 can be a different type of engine as would occur to one skilled in the art, e.g. a two stroke diesel-fueled types, a four stroke crude oil fueled internal combustion engine, etc. Engine 20 includes a combustion chamber 21, a combustion chamber 22, a combustion chamber 23, a combustion chamber 24, a combustion chamber 25, a combustion chamber 26, and a crankshaft 27. The present description of engine 20 is directed to the primary components of engine 20 interacting with an engine fueling management system of the present invention, with other standard components of engine 20 as would be known to one skilled in the art not being specifically described herein. It should be appreciated that engine 20 is being schematically represented and that more or fewer combustion chambers may be employed as would occur to one skilled in the art.

An accelerator pedal 41 within compartment 13 be manipulated, physically or electrically, by an operator of vehicle 10 from a rotational position of 0% at one extreme to a rotational position of 100% at the other extreme. Throttle 40 is operatively coupled to pedal 41 to thereby synchronously rotate with pedal 41 between the 0% rotational position and 100% rotational position. The 0% rotational position represents an idle position for throttle 40.

Fueling system 50 includes a fuel source (not shown), e.g. a fuel tank, to thereby supply fuel by a fuel pathway 51 to combustion chambers 21–26 in accordance with a firing order as established by the engine fueling management system of the present invention. Fuel pathway 51 represents one or more fuel lines, signal paths, and/or other type of engine connections associated with conventional fueling systems. Preferably, engine 20 is configured for chamber-injection fueling, and fueling system 50 includes electronically controlled fuel injectors. Alternatively, other fueling arrangements may be utilized as would occur to one skilled in the art.

Transmission 60 includes a torque converter (not shown) operatively coupled to crankshaft 27. Transmission 60 is a combination mechanical and shift-by-wire type of automatic transmission. In other embodiments, transmission 60 can be a different type of transmission as would occur to one skilled in the art, e.g. a mechanical type of automatic transmission, a shift-by-wire type of transmission, a manual transmission, etc. A propeller shaft 70 is operatively coupled to transmission 60. A drive axle 71 is operatively coupled to propeller shaft 70. A pair of wheels 73*a* and 73*b* are operatively coupled to a drive axle 72. A pair of wheels 73*c* and 73*d* are operatively coupled to drive axle 71. Engine 20 is the prime mover for vehicle 10 that provides mechanical power to transmission 60 whereby propeller shaft 70, drive axle 71, drive axle 72, wheel 73*a*, wheel 73*b*, wheel 73*c*, and wheel 73*d* are rotated.

Within compartment 13, vehicle 10 also comprises a brake pedal 80. Brake pedal 80 can be manipulated by an operator of vehicle 10 from a rotational position of 0% at one extreme to a rotational position of 100% at the other extreme. Brake pedal can be any type of pedal.

Still referring to FIG. 1, one embodiment of the engine fueling management system of the present invention includes a engine controller 90 , an vehicle controller 100, a coolant temperature sensor 28, an air temperature sensor 31, a throttle position sensor 42, a vehicle speed sensor 74, and a brake position sensor 81. Engine controller 90 and vehicle controller 100 are preferably electronic subsystems, each being comprised of one or more components of a common engine control unit (hereinafter "the common ECU") (not shown) that is powered by a battery (not shown). Engine controller 90 and vehicle controller 100 may include digital circuitry, analog circuitry, and/or hybrid circuitry. Engine controller 90 and vehicle controller 100 can include multiple components that are physically positioned at different locations within vehicle 10. In the illustrated embodiment, engine controller 90 includes a memory 91 and a central processing unit 92 (hereinafter "CPU 92"), and engine controller includes a memory 101 and a central processing unit 102 (hereinafter "CPU 102").

Memory 91 and memory 101 are of the solid-state electronic variety, and may be embodied in one or more components. In other embodiments, memory 91 and memory 101 may alternatively or concurrently include magnetic or optical types of memory. Memory 91 and memory 101 can be volatile, nonvolatile, or a combination of both volatile and nonvolatile types of memory. While it is preferred that memory 101 be integrally included in the common ECU and memory 91 be remotely distributed for access via a local area network 110 (hereinafter "LAN 110"), in other embodiments, memory 91 is remotely distributed for access via LAN 110 and/or memory 101 is integrally included in the common ECU. In still other embodiments, memory 91 and memory 101 are provided by a single integral memory.

CPU 92 is configured to access memory 91 101 and is remotely distributed for access via LAN. CPU 92 is a programmable, microprocessor-based device that executes instructions stored in memory 91, and accesses memory 91 to read or write data in accordance with the instructions. CPU 102 is configured to access memory 110 and is mounted on the common ECU. CPU 102 is a programmable, microprocessor-based device that executes instructions stored in memory 101, and accesses memory 101 to read or write data in accordance with the instructions. In other embodiments, CPU 92 is integrally included in the common ECU and/or CPU 102 is remotely distributed for access via LAN 110. In yet other embodiments, CPU 92 and/or CPU 102 can alternatively be implemented as a dedicated state machine, or a hybrid combination of programmable and dedicated hardware. In still other embodiments, engine controller 90 and vehicle controller 100 are provided by a single integral processing unit. Engine controller 90 and vehicle controller 100 further include any interfaces, control clocks, signal conditioners, signal converters, filters, communication ports, or any other type of operators as would occur to one skilled in the art to implement the principles of the present invention.

Still referring to FIG. 1, engine controller 90 is in electrical communication with fueling system 50 by a signal path 93 to thereby provide a fueling meter signal $FM_s$ that is indicative of a level of fuel to be supplied to a selected combustion chamber of combustion chambers 21–26. Specifically, an active fuel injector (not shown) of fueling system 50 conventionally expels fuel therefrom at a fixed rate. Fueling meter signal $FM_s$ informs fueling system 50 of a fixed length of time to activate the fuel injector such that a desired level of fuel is supplied to the selected combustion chamber. Vehicle controller 100 is in electrical communication with transmission 60 by a signal path 61 to exchange a plurality of transmission management signals $TM_s$ for managing the operation of transmission 60, and a plurality of transmission condition signals $TC_s$ that are indicative of the operating state of transmission 60. Engine controller 90 receives a transmission operation signal $TO_s$ from vehicle controller 100 via LAN 110 wherein vehicle condition signal $VO_s$ is also indicative of an operating state of the various components of vehicle 10 other than engine 20 and associated components of vehicle 10.

Coolant temperature sensor 28 is in electrical communication with engine controller 90 by a signal path 29. Coolant temperature sensor 28 is a conventional temperature sensor positioned within respect to a cooler passage (not shown) of engine 20 to thereby provide a coolant temperature signal $CT_s$ to engine controller 90 via signal path 29. Coolant temperature signal $CT_s$ is an indication of the internal temperature of the coolant with the cooler passage.

Air temperature sensor 31 is in electrical communication with engine controller 90 by a signal path 32. Air temperature sensor 31 is a conventional temperature sensor positioned within intake manifold 30 to thereby provide a air temperature signal $AT_s$ to engine controller 90 via signal path 32. Air temperature signal $AT_s$ is an indication of the internal temperature of intake air within intake manifold 30. As will be further described herein, temperature signal $AT_s$ is utilized as a representation of a temperature ambient engine 20.

Throttle position sensor 42 is in electrical communication with engine controller 90 by a signal path 43. Throttle position sensor 42 is a conventional magnetic sensor positioned with respect to throttle 40 to thereby provide a throttle position signal $TP_s$ to engine controller 90 via signal path 43. Throttle position signal $TP_s$ is an indication of a rotational position of throttle 40. Alternatively or additionally, throttle position signal $TP_s$ can be derived from a detected rotational position of accelerator pedal 41 which can be manually operated or electronically operated by a cruise control system as taught by commonly owned U.S. Pat. No. 5,738,606, that is hereby incorporated by reference.

Engine speed sensor 62 is in electrical communication with engine controller 90 by a signal path 63. Engine speed sensor 62 is a conventional magnetic sensor positioned with respect to crankshaft 27 to thereby provide an engine speed signal $ES_s$ to engine controller 90 via signal path 63. Engine speed signal $ES_s$ is an indication of a rotational speed of crankshaft 27. Engine speed sensor 62 can alternatively be positioned with respect to propeller shaft 70 to thereby provide engine speed signal $ES_s$ as would occur to one skilled in the art.

Vehicle speed sensor 74 is in electrical communication with vehicle controller 100 by a signal path 75. Vehicle speed sensor 74 is conventional magnetic sensor positioned relative to wheel 73*b* to provide a vehicle speed signal $VS_s$ to vehicle controller 100 via signal path 75. Vehicle speed signal $VS_s$ is an indication of a rotational speed of wheels 73*a*–73*d*.

Brake position sensor 81 is in electrical communication with vehicle controller 100 by a signal path 82. Brake position sensor 81 is a conventional magnetic sensor positioned with respect to brake pedal 80 to thereby provide a brake position signal $BP_s$ to vehicle controller 100 via signal path 82. Brake position signal $BP_s$ is an indication of a rotational position of brake pedal 80.

In other embodiments of the present invention, coolant temperature signal $CT_s$, air temperature signal $AT_s$, throttle position signal $TP_s$, engine speed signal $ES_s$, vehicle speed signal $VS_s$ and/or brake position signal $BP_s$ can be provided by other types of sensors.

Figure 2:
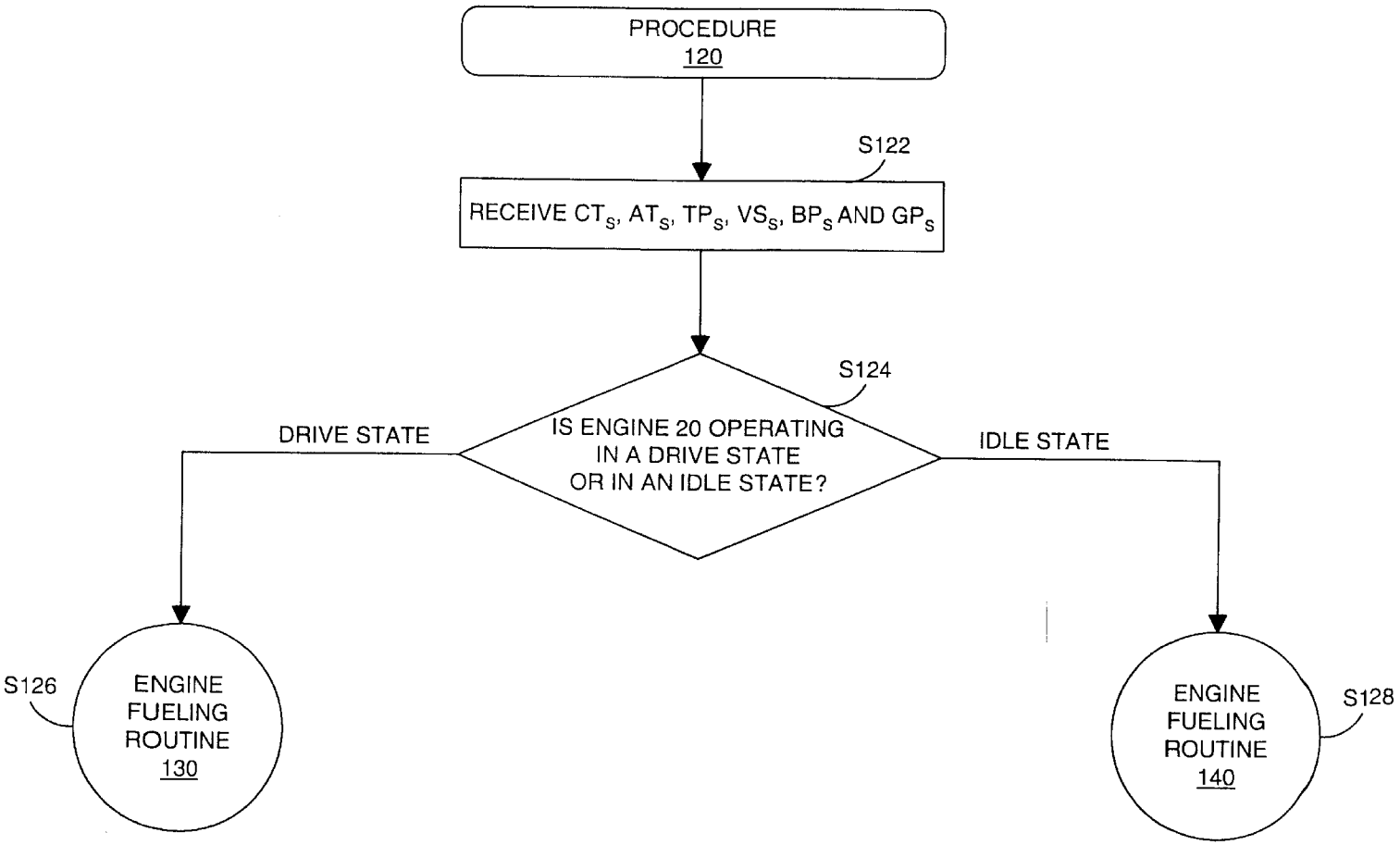
FIG. 2 is a flow chart of one embodiment of an engine fueling management procedure of the present invention for operating a FIG. 1 diesel engine.

Referring additionally to FIG. 2, one embodiment of an engine fueling management procedure 120 for implementing the engine fueling management technique of the present invention is shown. Procedure 120 is implemented by engine controller 90 upon receipt of a signal from vehicle controller 100 via LAN 110 indicating that an ignition switch (not shown) of vehicle 10 is positioned in a START position or an ON position. During stage S122 of procedure 120, coolant temperature signal $CT_s$, throttle position signal $TP_s$, vehicle speed signal $VS_s$, brake position signal $BP_s$ and a gear position signal $GP_s$ are received by engine controller 90 as well as other signals known to one skilled in the art. Gear position signal $GP_s$ is embedded within transmission condition signals $TC_s$ as received by vehicle controller 100, and is indicative of a gear position of transmission 60, e.g. $1^{St}$ gear, $2^{nd}$ gear, park, neutral, etc., as would occur to one skilled in the art. Coolant temperature signal $CT_s$, throttle position signal $TP_s$, vehicle speed signal $VS_s$, brake position signal $BP_s$ and gear position signal $GP_s$ are continually received thereafter by engine controller 90 until the ignition switch is positioned in an OFF position.

During stage S124 of procedure 120, engine controller 90 initially determines whether engine 20 is operating in a drive state or an idle state. For the embodiment of vehicle 10 illustrated herein, engine controller 90 makes this initial determination as a function of coolant temperature signal $CT_s$, throttle position signal $TP_s$, vehicle speed signal $VS_s$, brake position signal $BP_s$ and gear position signal $GP_s$. For the illustrated embodiment, engine 20 is operating in an idle state when coolant temperature signal $CT_s$ indicates a coolant temperature less than or equal to 140° F., throttle position signal $TP_s$ indicates throttle valve 41 is at the 0% position, vehicle speed signal $VS_s$ indicates a vehicle speed less than or equal to 2 MPH, brake position signal $BP_s$, brake position signal $TP_s$ indicates brake pedal 80 is at the 0% position, and gear position signal $GP_s$ indicates transmission 60 is in park or neutral. Engine 20 is operating in a drive state if any one of the above mentioned parameters for the signals is not initially indicated. Engine 20 is operating in a drive state after an determined idle state if any of the above mentioned parameters for throttle position signal $TP_s$, vehicle speed signal $VS_s$, brake position signal $BP_s$ and transmission condition signal $TC_s$ are no longer being indicated or coolant temperature signal $CT_s$ indicates a coolant temperature greater than 175° F.

In other embodiments, different parameters for coolant temperature signal $CT_s$, throttle position signal $TP_s$, vehicle speed signal $VS_s$, brake position signal $BP_s$ and/or gear position signal $GP_s$ are utilized to determine if engine 20 is operating in an idle state. In still other embodiments, other signals as would occur to one skilled in the art can concurrently or alternatively be received during stage S122 to determine if engine 20 is operating in an idle state.

If engine controller 90 determines engine 20 is operating in a drive state during stage S122, engine controller 90 executes a conventional engine fueling routine 130 as would occur to one skilled in the art for supplying fuel to combustion chambers 21–26 in a specific firing order. If engine controller 90 determines engine 20 is operating in an idle state during stage S122, engine controller 90 executes a unique engine fueling routine 140 for supplying fuel to either combustion chambers 21–26 in a specific firing order, or combustion chambers 21, 23, and 25 in a specific firing order. Engine controller 90 continually determines the operating state of stage S122 until the ignition switch is positioned in an OFF position. Consequently, it is to be appreciated that routine 130 is being executed while routine 140 is not being executed, and vice-versa.

Figure 3:
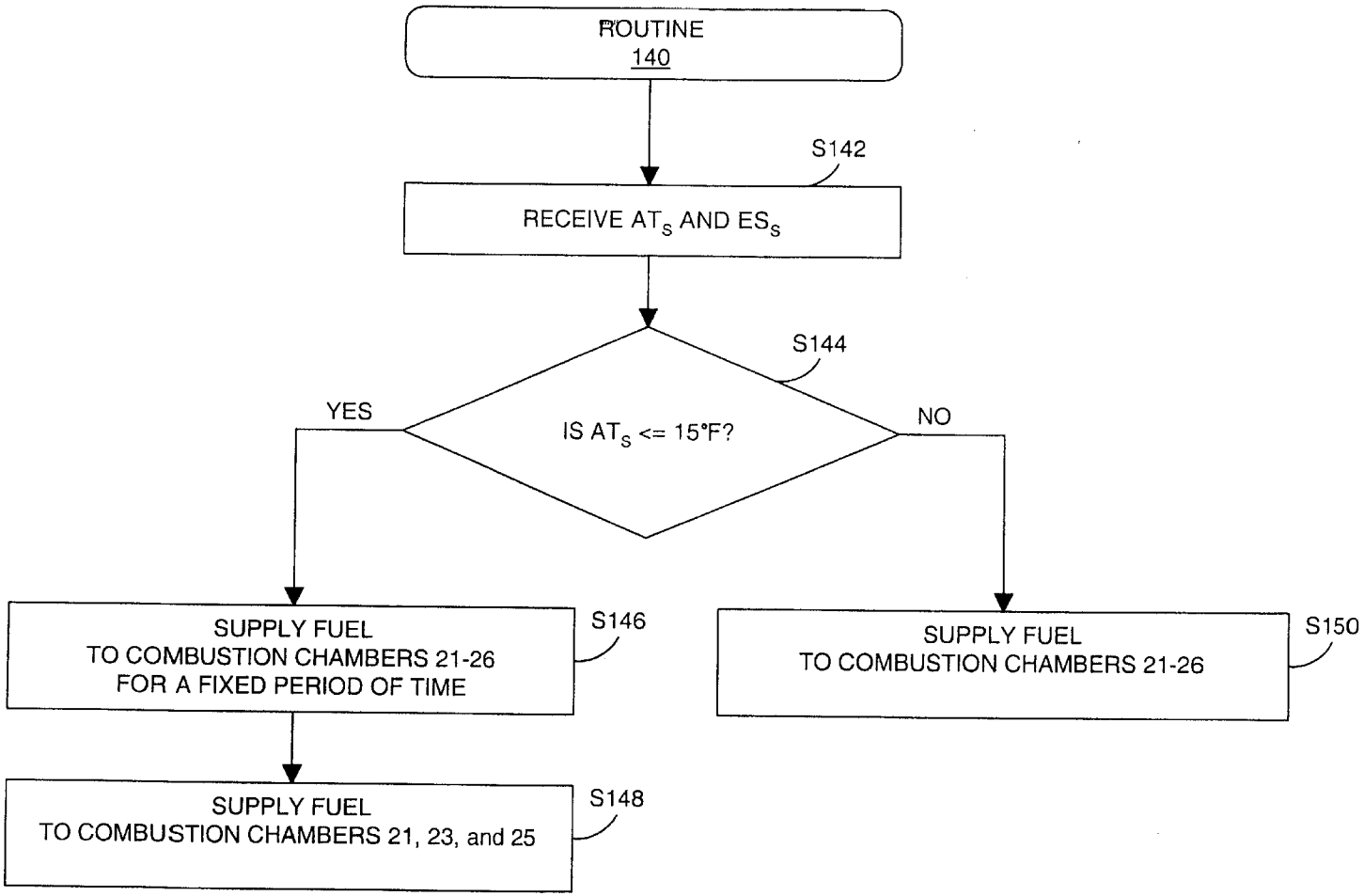
FIG. 3 is a flow chart of one embodiment of an engine fueling routine of the present invention for idling the FIG. 1 diesel engine.

Referring additionally to FIG. 3, one embodiment of an engine fueling routine 140 of the present invention is shown. During stage S142 of routine 140, air temperature signal $AT_s$ and engine speed signal $ES_s$ are received by engine controller 90 as well as other signals as known to one skilled in the art. Air temperature signal $AT_s$ and engine speed signal $ES_s$ are continually received thereafter by engine controller 90 until routine 140 is terminated or the ignition switch is positioned in an OFF position.

Engine controller 90 determines if air temperature signal $AT_s$ is less than or equal to 15° F. during stage S144 of routine 140. For this embodiment, air temperature signal $AT_s$ being less than or equal to 15° F. is representative of a temperature ambient to engine 20 for facilitating the creation of distillates within combustion chambers 21–26. For other embodiments, air temperature signal $AT_s$ can be tested during stage S144 against a different temperature that is considered representative of a temperature ambient to engine 20 for facilitating the creation of distillates within combustion chambers 21–26.

Engine controller 90 proceeds to stage S146 of routine 140 if engine controller 90 determines air temperature signal $AT_s$ is less than or equal to 15° F. During stage S146, engine controller 90 provides fueling meter signal $FM_s$ to fueling system 50 via path 93 whereby fueling system 50 supplies fuel to combustion chambers 21–26 for a fixed period of time in response to fueling meter signal $FM_s$. Consequently, the firing order for stage S146 includes all six (6) combustion chambers 21–26. Preferably, if air temperature signal $AT_s$ is less than or equal to 0° F. fueling system 50 supplies fuel to combustion chambers 21–26 for twenty (20) seconds whereby crankshaft 27 is rotated at approximately 1,000 RPM as indicated by engine speed signal $ES_s$. It is also preferred that if air temperature signal $AT_s$ is greater than 0° F. and less than or equal to 15° F., fueling system 50 supplies fuel to combustion chambers 21–26 for one (1) minute whereby crankshaft 27 is rotated at approximately 800 RPM as indicated by engine speed signal $ES_s$.

Upon completion of stage S146, engine controller 90 proceeds to stage 148 of routine 140. During stage S148, engine controller 90 provides fueling meter signal $FM_s$ to fueling system 50 via path 93 whereby fueling system 50 supplies fuel to combustion chambers 21, 23, and 25 in response to fueling meter signal $FM_s$. Consequently, the firing order for stage S146 includes only combustion chambers 21, 23, and 25. Preferably, if air temperature signal $AT_s$ is less than or equal to 0° F., fueling system 50 supplies fuel to combustion chambers 21, 23, and 25 whereby the rotation of crankshaft 27 is accelerated from approximately 1,000 RPM to approximately 1,200 RPM at a rate of 13 RPM/sec as indicated by engine speed signal $ES_s$. It is also preferred that if air temperature signal $AT_s$ is greater than 0° F. and less than or equal to 15° F., fueling system 50 supplies fuel to combustion chambers 21, 23, and 25 whereby the rotation of crankshaft 27 is accelerated from approximately 800 RPM to approximately 1200 RPM at a rate of 13 RPM/sec as indicated by engine speed signal $ES_s$.

It is to be appreciated that stage S146 and stage S148 are executed during an idle state of engine 20 whereby distillates of unburned fuel with combustion chambers 21–26 could be created therein as indicated by air temperature signal $AT_s$. It is to be further appreciated that substantial, if not complete, combustion of fuel within combustion chambers 21, 23, and 25 occurs during stage S148 due to the increased amount of power combustion chambers 21, 23, and 25 must provide to accelerate crankshaft 27. Thus, the creation of distillates within combustion chambers 21–26 is diminished, if not eliminated. In other embodiments of the present invention, any number less than all six (6) of combustion chambers 21–26 can receive fuel during stage S148 whereby substantial, if not complete, combustion is occurring within the combustion chambers receiving fuel.

Engine controller 90 proceeds to stage S150 of routine 140 if vehicle controller 100 determines air temperature signal $AT_s$ is greater than 15° F. During stage S150, vehicle controller 100 provides fueling meter signal $FM_s$ to fueling system 50 via path 93 whereby fueling system 50 supplies fuel to combustion chambers 21–26 in response to fueling meter signal $FM_s$. Consequently, the firing order for stage S150 includes all six (6) combustion chambers 21–26. Preferably, if air temperature signal $AT_s$ is greater than 15° F. and less than or equal to 32° F., fueling system 50 supplies fuel to combustion chambers 21–26 for one (1) minute whereby crankshaft 27 is rotated at approximately 800 RPM as indicated by engine speed signal $ES_s$, and thereafter accelerates crankshaft 27 from approximately 800 RPM to approximately 1,200 RPM at a rate of 13 RPM/sec. It is also preferred that if air temperature signal $AT_s$ is greater than 32° F., fueling system 50 supplies fuel to combustion chambers 21–26 whereby crankshaft 27 is rotated at approximately 800 RPM as indicated by engine speed signal $ES_s$.

It is to be appreciated that stage S150 is executed during an idle state of engine 20 when there is a no risk as indicated by air temperature signal $AT_s$ of distillates being created within combustion chambers 21–26 due to unburned fuel therein. It is to be further appreciated that engine controller 90 is continually monitoring air temperature signal $AT_s$. Consequently, engine controller 90 can be shifting back and forth between stage S146 and stage S148, collectively, and stage S150 whenever air temperature signal $AT_s$ is fluctuating around 15° F. or whatever the temperature parameter may be.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method, comprising:

operating a diesel engine including a first set of at least one combustion chamber and a second set of at least one combustion chamber;

determining an operating state of the diesel engine, the operating state including a drive state and an idle state;

sensing the temperature of air within the intake manifold of the diesel engine to provide a temperature comparison value;

injecting fuel into the first set of at least one combustion chamber and the second set of at least one combustion chamber in response to said determining the diesel engine is operating in the drive state;

delivering fuel into the first set of at least one combustion chamber and the second set of at least one combustion chamber for a predetermined period of time in response to said determining the diesel engine is operating in the idle state and the temperature comparison value being less than or equal to a predetermined temperature value; and injecting fuel to only the first of the at least one combustion chamber in response to said determining that the diesel engine is operating in the idle state and that the temperature comparison value is less than or equal to the predetermined value, said injecting occurs sequentially after said delivering.

2. A method, comprising:

determining whether a diesel engine having a plurality of combustion chambers is operating in an idling state or a drive state;

supplying fuel to the plurality of combustion chambers when the diesel engine is operating in the drive state;

sensing the air temperature within the intake manifold of the diesel engine to obtain a sensed temperature;

injecting fuel for a predetermined period of time to the plurality of combustion chambers when the sensed temperature is less than or equal to a predetermined temperature and the diesel engine is operating in the idle state;

fueling only a subset of the plurality of combustion chambers with fuel after said injecting and while the engine is operating in the idling state; and increasing the operating speed of the diesel engine during said fueling to a predetermined operating speed.

3. The method of claim 1, which further includes increasing the engine speed during said injecting fuel into only the first of the at least one combustion chamber.

4. The method of claim 1, wherein the predetermined temperature value defines a value representative of a temperature ambient to the engine that facilitates the creation of a distillate within the plurality of combustion chambers.

5. The method of claim 2, wherein the predetermined temperature defines a value representative of a temperature ambient to the engine that facilitates the creation of a distillate within the plurality of combustion chambers.

6. The method of claim 2, wherein the plurality of combustion chambers is defined by six combustion chambers, and wherein said fueling delivers the fuel to only three of the combustion chambers.

7. The method of claim 2, wherein the subset defines only one half of the plurality of combustion chambers.

8. The method of claim 2, wherein the predetermined temperature is 15° F.

9. The method of claim 2, wherein when the sensed temperature is less than or equal to 0° F the predetermined period of time is 20 seconds, and which further includes operating the diesel engine at a speed of 1000 RPM during the predetermined period of time, and wherein said increasing accelerates the diesel engine from 1000 RPM to 1200 RPM at a rate of 13 RPM/sec.

10. The method of claim 2, wherein when the sensed temperature is greater than 0° F and less than or equal to 15° F the predetermined period of time is one minute, and which further includes operating the diesel engine at a speed of 800 RPM during the predetermined period of time, and wherein said increasing accelerates the diesel engine from 800 RPM to 1200 RPM at a rate of 13 RPM/sec.

11. The method of claim 2, which further includes substantial combustion of the fuel from said fueling and diminishing the formation of distillates in the plurality of combustion chambers.

12. The method of claim 2, wherein the predetermined temperature defines a valve representative of a temperature ambient to the engine that facilitates the creation of a distillate within at least one of the plurality of combustion chambers;

wherein the subset defines only one half of the plurality of combustion chamber; and which further includes substantial combustion of the fuel from said fueling and diminishing the formation of distillates in the at least one of the plurality of combustion chambers.

13. The method of claim 12, wherein when the sensed temperature is less than or equal to 0° F the predetermined period of time is 20 seconds, and which further includes operating the diesel engine at a speed of 1000 RPM during the predetermined period of time, and wherein said increasing accelerates the diesel engine from 1000 RPM to 1200 RPM at a rate of 13 RPM/sec.

* * * * *